US010460870B2

(12) United States Patent
Feng et al.

(10) Patent No.: US 10,460,870 B2
(45) Date of Patent: Oct. 29, 2019

(54) INDUCTION COIL ASSEMBLY AND WIRELESS POWER TRANSFER SYSTEM

(71) Applicant: NINGBO WEIE ELECTRONICS TECHNOLOGY LTD., Ningbo, Zhejiang (CN)

(72) Inventors: Weiyi Feng, Zhejiang (CN); Feng Yu, Zhejiang (CN)

(73) Assignee: NINGBO WEIE ELECTRONICS TECHNOLOGY LTD., Ningbo, Zhejiang (CN)

( * ) Notice: Subject to any disclaimer, the term of this patent is extended or adjusted under 35 U.S.C. 154(b) by 123 days.

(21) Appl. No.: 15/617,176

(22) Filed: Jun. 8, 2017

(65) Prior Publication Data

US 2017/0358955 A1 Dec. 14, 2017

(30) Foreign Application Priority Data

Jun. 11, 2016 (CN) ..... 2016 1 0407870

(51) Int. Cl.
*H01F 38/14* (2006.01)
*H01F 27/28* (2006.01)

(52) U.S. Cl.
CPC ..... *H01F 38/14* (2013.01); *H01F 27/2804* (2013.01)

(58) Field of Classification Search
CPC ..... H01F 27/2804; H01F 38/14; H01F 2027/2809
USPC ..... 307/104
See application file for complete search history.

(56) References Cited

U.S. PATENT DOCUMENTS

2013/0257362 A1* 10/2013 Lim ..... H02J 50/70 320/108
2015/0102890 A1* 4/2015 Nakamura ..... H01F 27/2804 336/200
2015/0340150 A1* 11/2015 Nakamura ..... H01F 27/24 336/200
2016/0035477 A1* 2/2016 Yeh ..... H01F 27/2804 320/108
2016/0056639 A1* 2/2016 Mao ..... H02J 50/80 307/104
2016/0217911 A1* 7/2016 Mano ..... H01F 27/2804

FOREIGN PATENT DOCUMENTS

CN 103366931 A 10/2013
CN 104517941 A 4/2015
CN 104701947 A 6/2015
(Continued)

*Primary Examiner* — Hal Kaplan
(74) *Attorney, Agent, or Firm* — Yue(Robert) Xu; Apex Attorneys at Law, LLP

(57) ABSTRACT

An induction coil assembly and a wireless electrical power transmission system are disclosed. A wire that forms the induction coil assembly is wound on a first surface and a second surface of a substrate, two parts of the wire are coupled with each other via a through hole of the substrate, and the coil on the first surface and the coil on the second surface are wound in order of an upper surface to a lower surface, or are cross-wound according to upper-lower surfaces, so that an area surrounded by each winding of the coil is increased as much as possible on the premise of limited substrate dimensions, thereby maximizing the total inductance value of the coil and increasing an induced voltage of the coil.

11 Claims, 5 Drawing Sheets

(56) References Cited

FOREIGN PATENT DOCUMENTS

| | | | |
|---|---|---|---|
| CN | 104766714 | A | 7/2015 |
| CN | 204480870 | U | 7/2015 |
| CN | 105050372 | A | 11/2015 |
| CN | 204809833 | U | 11/2015 |
| CN | 205029441 | U | 2/2016 |
| CN | 205142776 | U | 4/2016 |
| CN | 105845404 | A | 8/2016 |

* cited by examiner

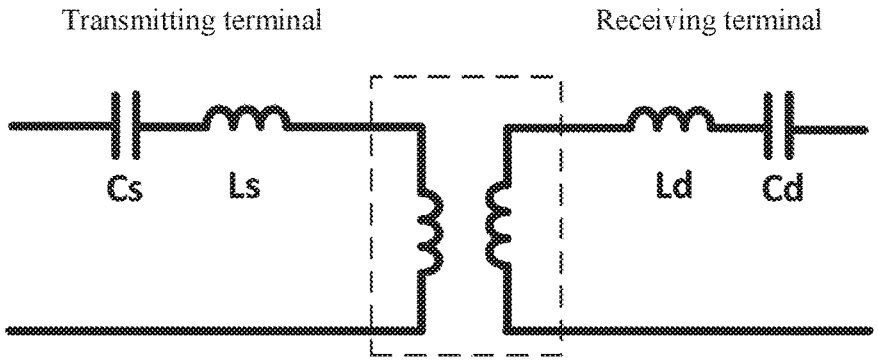
Fig. 1-- Prior Art --
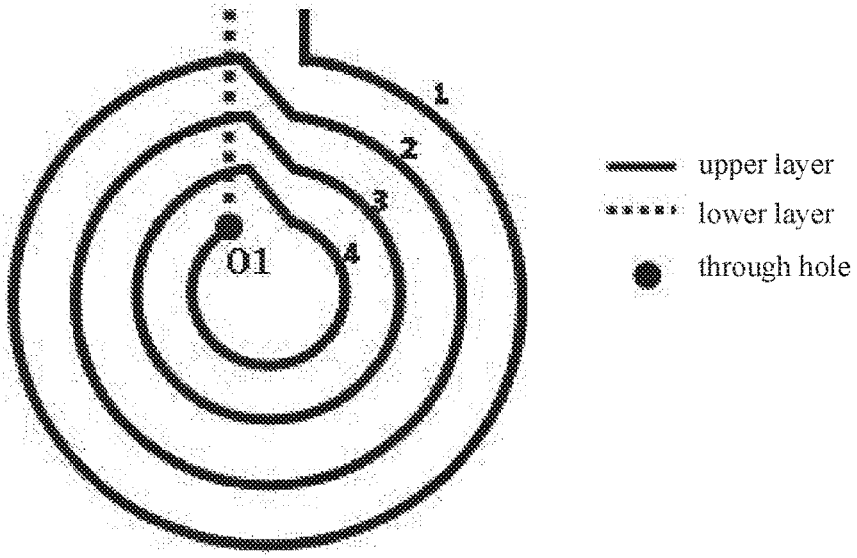
Fig. 2-- Prior Art --

INDUCTION COIL ASSEMBLY AND WIRELESS POWER TRANSFER SYSTEM

CLAIM OF PRIORITY AND CROSS-REFERENCE TO RELATED APPLICATION(S)

This application claims the benefit of Chinese Patent Application No. 201610407870.X, filed on Jun. 11, 2016, which is incorporated herein by reference in its entirety.

BACKGROUND OF THE INVENTION

1. Field of the Invention

The present disclosure relates to the field of electrical power transmission, and particularly to an induction coil assembly and a wireless power transfer system.

2. Description of the Related Art

A magnetic resonance wireless power transfer system is shown in FIG. 1. In order to effectively transfer energy from a power transmitting terminal to a power receiving terminal, the power transmitting terminal is provided with a compensation capacitor Cs, and the compensation capacitor Cs and a transmitting coil inductor Ls resonate at a system operation frequency f0 (such as a frequency of 6.78 MHZ which is prescribed in standards of Wireless Power Consortium and Alliance for Wireless Power). Similarly, the power receiving terminal is also provided with a compensation capacitor Cd, and the compensation capacitor Cd and a receiving coil inductor Ld also resonate at the frequency f0. According to the circuit in FIG. 1, a coil of the power transmitting terminal and a coil of the power receiving terminal are coupled in a magnetic resonance manner at a same frequency, so that the electrical power from the transmitting side is transferred to a load at the receiving side for using.

According to the abovementioned magnetic coupling process, an alternating magnetic field is generated by the coupling of the receiving coil of the receiving side and the transmitting coil, an induced voltage Ud of the alternating magnetic field is expressed by the following equation:

$$Ud=\omega 0*Ip*k*\sqrt{Ls*Ld}$$

Wherein, ω0 denotes a resonance frequency, Ip denotes a current in the transmitting coil, k denotes a coupling coefficient between the transmitting coil and the receiving coil, Ls denotes an inductance value of the transmitting coil, and Ld denotes an inductance value of the receiving coil.

As can be seen from the abovementioned equation, in a case where the operation frequency is fixed and the transmitting current in the transmitting coil is constant, in order to increase the voltage induced by the receiving coil, it is necessary to optimize the structure of coil, in particular the structure of the receiving coil, so as to improve the magnetic field coupling ability of the receiving coil. Therefore, designers have to, within an effective range, on the one hand improve the inductance value Ld of the receiving coil, and on the other hand improve the coupling coefficient k between the transmitting coil and the receiving coil.

BRIEF DESCRIPTION OF THE INVENTION

In view of this, the present disclosure provides an induction coil assembly and a wireless power transfer system. By optimizing the winding manner of the induction coil, a higher inductance value may be achieved with relatively small coil dimensions, and the coupling coefficient k between the transmitting coil and the receiving coil may satisfy an efficiency requirement.

According to a first aspect of the present disclosure, an induction coil assembly is provided which comprises: at least one substrate, each including at least one through hole; a first part of a wire of the induction coil assembly wound on a first surface of the substrate; and a second part of the wire extended to a second surface of the substrate via one of the through holes of the substrate and wound on the second surface of the substrate.

Preferably, the wire forms a N-turn coil, the first part of the wire forms A windings, and the second part of the wire forms B windings, wherein when N is an even number, A is equal to N/2 and B is equal to N/2; when N is an odd number, A is equal to (N+1)/2, B is equal to (N−1)/2; or, A is equal to (N−1)/2, B is equal to (N+1)/2.

Preferably, locations of the windings on the first surface of the substrate and locations of the windings on the second surface of the substrate are overlapped by each other up and down.

Preferably, locations of the windings on the first surface of the substrate and locations of the windings on the second surface of the substrate are mutually staggered with each other up and down.

Preferably, the wire forms a N-turn coil, wherein a first winding of the coil is wound on the first surface of the substrate, the wire are extended to the second surface of the substrate via a first through hole and wound on the second surface of the substrate to form a i th winding and a (i+1)th winding of the coil; the wire are extended to the first surface of the substrate via a second through hole and wound on the first surface of the substrate to form a (i+2)th turn and a (i+3)th turn of the coil; and wherein i is equal to 2*j, j is an odd number greater than or equal to 1.

Preferably, the wire of the induction coil assembly comprises M strands of sub wires placed together, wherein M is a positive integer.

According to a second aspect of the present disclosure, an induction coil assembly is provided, which comprises: a substrate, each including at least one through hole and N layers; and a wire forming a N-turn coil with N windings wound on the N layers of the substrate, respectively; wherein each of the N windings is wound on a first surface of a layer, and the wire is extended to an adjacent next layer via the through hole and wounded on the first surface of the adjacent next layer to form a next windings.

Preferably, a location of a winding on the first surface of one layer and a location of a winding on the first surface of an adjacent layer are overlapped by each other up and down.

Preferably, a location of a winding on the first surface of one layer and a location of a winding on the first surface of an adjacent layer are mutually staggered with each other up and down.

Preferably, wherein the wire of the induction coil assembly comprises M strands of sub wires placed together, wherein M is a positive integer.

According to a third aspect of the present disclosure, a wireless power transfer system is provided, which comprises: a power transmitting terminal receiving an externally inputted electrical power supply so as to generate a spatial magnetic field; and a power receiving terminal including a receiving coil and a voltage conversion circuit, wherein the receiving coil is coupled to the spatial magnetic field so as to obtain a high frequency voltage, and the voltage conversion circuit receives the high frequency voltage so as to generate an output voltage and supply the output voltage to a load, and wherein a structure of the receiving coil adopts the abovementioned induction coil assembly.

Preferably, the electrical power transmitting terminal includes: an inverter circuit receiving the externally inputted electrical power supply so as to generate a primary side alternating voltage; a transmitting coil receiving the primary side alternating voltage so as to generate the spatial magnetic field, and wherein a structure of the transmitting coil adopts the abovementioned induction coil assembly.

According to the abovementioned induction coil assembly and the wireless power transfer system, the windings of the induction coil assembly are wound on a first surface and a second surface of a subs-trate. Two parts of the wire a couple with each other via through holes, and the windings are wound in sequence or crosswise on the first surface and the second surface, so that an area surrounded by each winding of the coil is increased as much as possible with limited substrate dimensions, thereby maximizing the total inductance value of the coil and increasing an induced voltage of the coil.

BRIEF DESCRIPTION OF THE DRAWINGS

FIG. 1 is a schematic diagram showing a wireless power transfer system in the prior art;

FIG. 2 is a schematic diagram showing a conventional coil structure of a receiving coil in the prior art;

DETAILED DESCRIPTION OF EMBODIMENTS OF THE INVENTION

Several preferred embodiments of the present disclosure will be described in detail in conjunction with the accompanying drawings as follows. However, the present disclosure is not limited thereto.

In a coil assembly in the prior art, windings of a coil assembly are generally wound on one surface of a substrate (e.g. a printed circuit board) so as to achieve a desired inductance value. As shown in FIG. 2, herein, taking a dual layer PCB and a 4-turn coil as an example, a first winding, a second winding, a third winding and a fourth winding of the coil, as shown by the solid lines in FIG. 2, are wound on an upper surface (i.e. an upper layer) of the PCB. Then, the wire of the coil is guided to a second surface (namely a lower layer) of the PCB via a through hole O1, as shown by the dashed lines in FIG. 2, and then is guided out from the second surface to form two parallel lead interfaces for easy connection with other interfaces.

As can be seen from the above-described winding manner, in the coil assembly, the first winding is at the outermost and surrounds a maximum area which leads to a maximum equivalent inductance value L1. The areas surrounded by other windings decreases in turn. The fourth winding is at the innermost and surrounds a minimum area which leads to a minimum equivalent inductance value L4. Although the inductance value of the first winding of such coil assembly is relatively high, the total inductance value of all the four windings of the coil is not high enough. If a preset inductance value is required for a receiving coil, a PCB with a relatively large area is required, which is not conducive to integration and cost. If the receiving coil is formed on a PCB with certain dimensions, the total inductance value is low, and it can be seen from the equation in background that the receiving coil has a low capacity of inducing voltage, which leads to a low efficiency.

Thus, the present disclosure proposes an induction coil assembly applied in a wireless power transfer system. The wireless power transfer system comprises a power transmitting terminal and a power receiving terminal. The power transmitting terminal receives an externally inputted electrical power supply so as to generate a spatial magnetic field. The power receiving terminal comprises a receiving coil and a voltage conversion circuit. The receiving coil is coupled to the spatial magnetic field so as to obtain a high frequency alternative voltage. The voltage conversion circuit receives the high frequency alternative voltage and generates an output voltage to drive a load.

Figure 3:
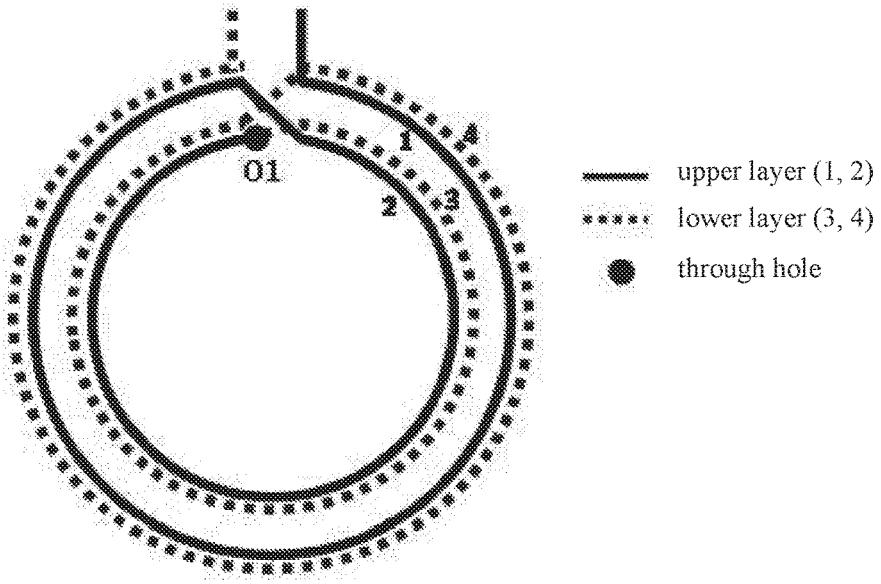
FIG. 3 is a top view of a receiving coil assembly according to a first embodiment of the present disclosure.

The receiving coil assembly of the wireless power transfer system is shown in FIG. 3. With reference to Fig, 3, which is a top view of the receiving coil assembly according to a first embodiment of the present disclosure, herein, it is described by still taking a dual layer PCB and a 4-turn coil as an example. However, those skilled in the art should understand that the number of windings of the coil is not limited thereto. As shown in FIG. 3, the substrate (PCB) includes at least one through hole, for example, a through hole O1. The wire forms an N-turn coil. A first part (that is, windings on a first surface of the substrate) of the wire includes an A-turn coil and a second part (that is, windings on a second surface of the substrate) of the wire includes a B-turn coil. When N is an even number, A is equal to N/2, and B is equal to N/2. When N is an odd number, A is equal to (N+1)/2 and B is equal to (N−1)/2; alternatively, A is equal to (N−1)/2 and B is equal to (N+1)/2.

For example, in the present embodiment, the wire of the coil assembly totally forms four windings. The first part of the wire includes two windings in the first half of the coil, namely, the first winding and the second winding shown in FIG. 3. The second part thereof includes two windings in the second half of the coil, namely, the third winding and the fourth winding shown in FIG. 3. The first winding and the second winding are located on the first surface (i.e. the upper layer shown in FIG. 3) of the PCB. Following the first winding and the second winding of the coil, the wire is guided through the through hole O1, and extended onto the second surface (i.e. the lower layer shown in FIG. 3) of the PCB to form the third winding and the fourth winding of the coil. Finally, the wire of the coil is led out from the fourth winding. In the present embodiment, the third winding is located below the second winding, and the fourth winding is located below the first winding.

Those skilled in the art may deduce that when the wire forms an N-turn coil and N is an odd number, one more winding should be wound on the first surface or on the second surface of the PCB, however, the winding manner is the same as described when N is an even number.

As can be seen from the above-described manner, the coil structure formed according to the winding manner of the present embodiment is similar to a solenoid, in which the area of each winding is not much different. For example, the area surrounded by the third winding and the area surrounded by the fourth winding would not be reduced too much, but are approximately the same as the area surrounded by the first winding and the area surrounded by the second winding. Thus, the total area surrounded by the four windings is greatly increased which may increase the total inductance value greatly. Therefore, the total inductance value of the induction coil assembly is increased on the premise of limited PCB dimensions. Compared with the coil structure in the prior art shown in FIG. 2, the limited area is fully used in the present embodiment to increase the inductance value in a maximum extent.

However, it is further found that, in the induction coil assembly shown in FIG. 3, when a current or voltage is induced by coupling the coil to the magnetic field, when a high frequency alternating current flows through the induction coil, the current flows through the first winding, the second winding, the third winding and the fourth winding successively. As a result, there exists a big difference between the voltage of the first winding and the voltage of the fourth winding due to the influence of the inductance of each winding. As shown in FIG. 3, since the fourth winding is located below the first winding, there exists a parasitic capacitance between windings, the voltage difference may result in a reactive current (I=C dV/dt) in the coil. The reactive current will generate reactive power which has negative impact on the power transmission efficiency.

Figure 4:
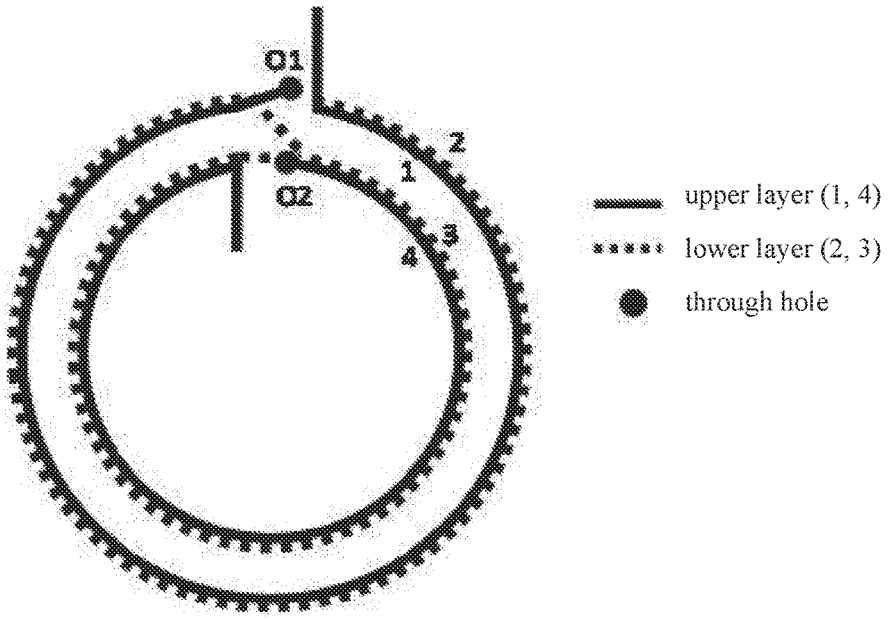
FIG. 4 is a top view of a receiving coil assembly according to a second embodiment of the present disclosure.

For this reason, further referring to FIG. 4, it is proposed a top view of a receiving coil structure according to a second embodiment of the present disclosure. In the present embodiment, the wire forms an N-turn coil. A first winding is wound on a first surface (i.e. an upper layer in FIG. 4) of a substrate. An ith winding and a (i+1)th winding are wound on a second surface (i.e. a lower layer in FIG. 4) of the substrate. The wire of the coil extends from the first surface onto the second surface via a first through hole of the substrate. A (i+2)th winding and a (i+3)th winding of the coil are wound on the first surface of the substrate. The wire of the coil extends from the second surface onto the first surface via a second through hole. Wherein, i is equal to 2*j, and j is an odd number greater than or equal to 1.

For example, as shown in FIG. 4, the winding forms an N-turn coil. The first winding of the coil is wound on the first surface of the substrate. The second winding and the third winding of the coil are wound on the second surface of the substrate with the wire extended onto the second surface via a through hole O1 of the substrate. The fourth winding and the fifth winding of the coil are wound on the first surface of the substrate with the wire extended onto the first surface via a through hole O2. And then, the sixth winding and the seventh winding are wound on the second surface of the substrate with the wire extended onto the second surface via a through hole (not shown in FIG. 4), and so on.

As can be seen from FIG. 4, the winding manner of the present embodiment makes the structure of the induction coil assembly further close to a solenoid. Therefore, as the same as the technical effect of the embodiment shown in FIG. 3, the induction coil assembly according to the present embodiment may also obtain a relatively large inductance value on the premise of limited PCB dimensions. Moreover, by means of cross-winding the coil according to the present embodiment, the voltage difference between the first winding on the first surface and the second winding, which is correspondingly arranged with the first coil, on the second surface is relatively low, and the voltage difference between the third winding on the second surface and the fourth winding, which is correspondingly arranged with the third coil, on the first surface is relatively small, therefore, the reactive current between windings is also relatively small, thereby increasing the transmission efficiency.

Figure 5:
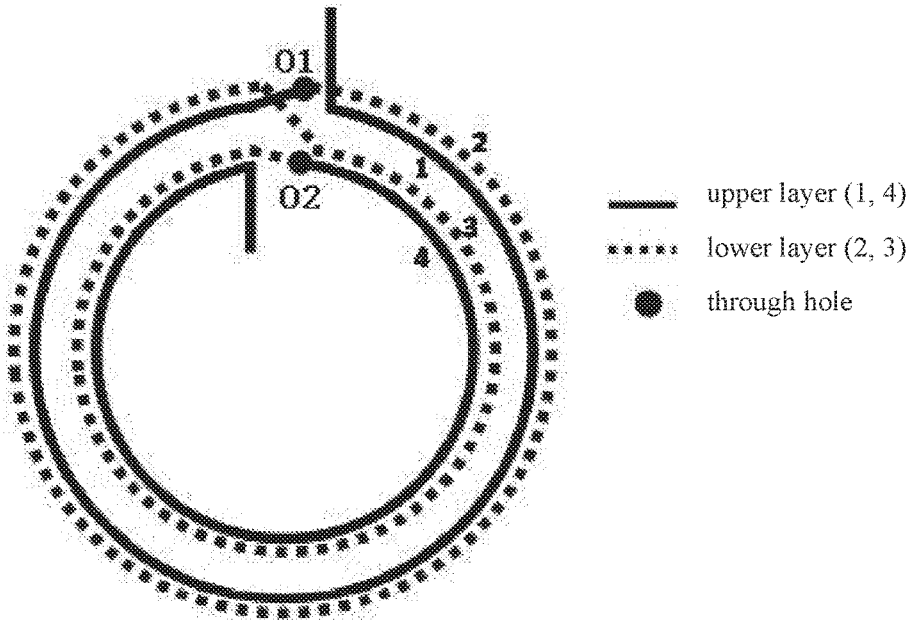
FIG. 5 is a top view of a receiving coil assembly according to a third embodiment of the present disclosure.

Moreover, in order to further reduce the reactive current in the abovementioned coil, it can be further seen from the equation of the reactive current that the reactive current may also be reduced by reducing the parasitic capacitances between windings. Therefore, referring to FIG. 5 which is a top view of a receiving coil structure according to a third embodiment of the present invention, the embodiment shown in FIG. 5 is an improvement on the basis of the embodiment shown in FIG. 4. The locations of the windings on the first surface and the locations of windings on the second surface are disposed in a staggered manner to reduce the parasitic capacitance between two corresponding windings of the coil, for example, the first winding and the second winding are disposed in a staggered manner and the third winding and the fourth winding are disposed in a staggered manner. Preferably, when an upper winding and a lower winding are shifted to an extent that their projections on the PCB do not overlap, the parasitic capacitance between windings is reduced to zero. Then no reactive current would be generated, thereby effectively improving the transmission efficiency.

It should be understood by those skilled in the art that the coil shown in FIG. 3 may also be disposed in a staggered manner. For example, the first winding and the fourth winding are disposed in a staggered manner and the second winding and the third winding are disposed in a staggered manner. Likewise, the parasitic capacitance between the upper winding and the lower winding may be reduced.

Figure 6:
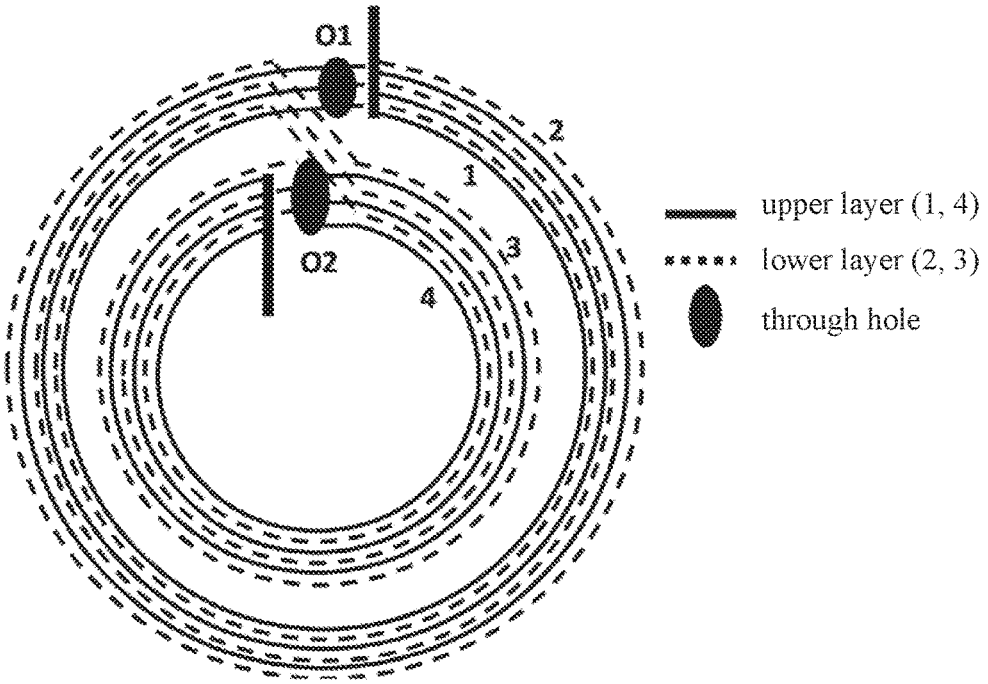
FIG. 6 is a top view of a receiving coil assembly according to a fourth embodiment of the present disclosure.

Furthermore, the wire in the abovementioned embodiment forming the coil structure is one strand of wire which requires a relatively large width. However, it is likely to cause skin effect leading to a small transmission current. Therefore, on the basis of the abovementioned embodiments, the wire may be arranged to comprise M strands of sub wires placed together, wherein M is a positive integer. As shown in FIG. 6, which is a further improvement on the basis of FIG. 5, taking an example that both the upper surface and the lower surface have two coil windings, three strands of sub wires are placed together to from a winding to transmit current, which enables larger transmission current and higher efficiency.

In conjugation with the abovementioned embodiments, it can be inferred that in the embodiments of FIG. 3 and FIG. 4, the up-down corresponded windings may also be replaced with a coil structure in which three strands of sub windings are placed together to form a winding. In the embodiment shown in FIG. 6, not only the up-down corresponded windings have the coil structure in which three strands of sub windings are placed together, but also locations of the sub windings at an upper layer and corresponding sub windings at a lower layer are disposed in a staggered manner, which may improve the transmission efficiency.

Finally, when the carrier (PCB) of the coil is of multi layers, each winding may be wound on a respective layer of the PCB. Each layer comprises at least one through hole, and the wire forms an N-turn coil. Each of the N windings is wound on a first surface of a layer, and the next one is extended to via the through hole and wound on the first surface of an adjacent next layer.

Figure 7:
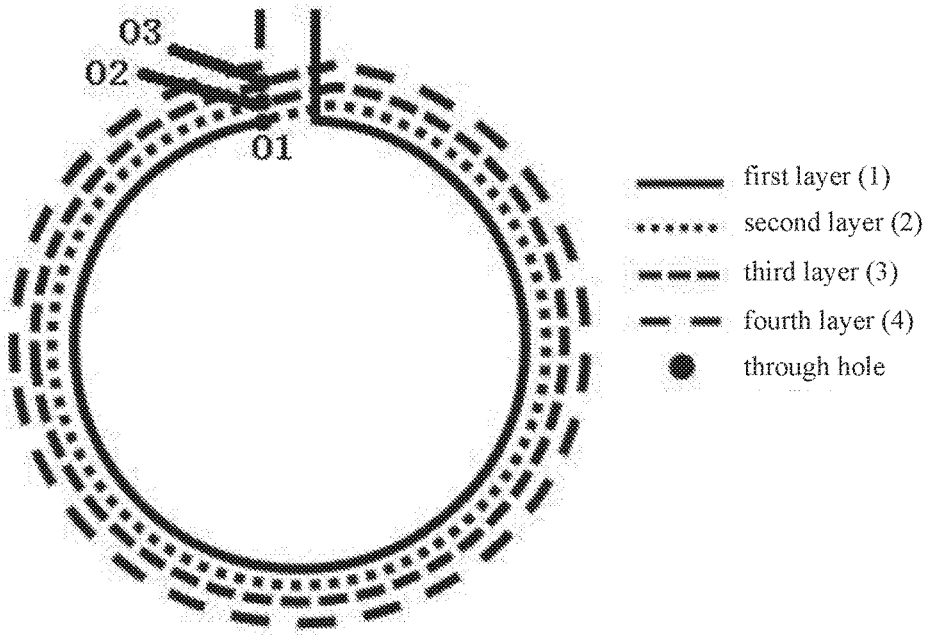
FIG. 7 is a top view of a receiving coil assembly according to a fifth embodiment of the present disclosure.

As shown in FIG. 7, taking a 4-layer PCB as an example, after a first winding is wound on a first layer of the PCB, the wire extends to a second layer of the PCB via a through hole O1 of the first layer to wind a second winding. The wire sequentially extends to a third layer of the PCB via a through hole O2 of the second layer to wind a third winding, and extends to a fourth layer of the PCB via a through hole O3 of the third layer to wind a fourth winding in sequence.

Apparently, according to the winding manner of the present embodiment, the area surrounded by each winding can be maximized, and a large inductance value may be obtained.

Likewise, in FIG. 7, the location of the winding on a layer and the location of the winding on an adjacent layer are overlapped by each other, which may improve the inductance value and the coupling ability of the induction coil.

Likewise, the location of the winding on a layer and the location of the winding on an adjacent layer are staggered with each other, which may reduce the parasitic capacitance between the upper winding and the lower winding and reduce the reactive current. Preferably, the projection, on the PCB, of each winding may be exactly staggered precisely, so that the reactive current is reduced to zero.

Likewise, the embodiments shown in FIG. 7 and FIG. 6 may be used in a combination manner, i.e. each winding of the multi-layer PCB comprises three strands of sub windings, so that the coil may have higher inductance value and better current transmission ability.

It should be understood by those skilled in the art that for the power transmitting terminal, the power transmitting terminal includes an inverter circuit and a transmitting coil. The inverter circuit receives the externally inputted power supply so as to generate primary side alternating voltage.

The transmitting coil receives the primary side alternating voltage so as to generate the spatial magnetic field. Wherein, the structure of the transmitting coil adopts the abovementioned induction coil assembly. Finally, the structure of the a.bovementioned induction coil assembly is not limited to be applied in the wireless power transfer system, but also be applied in other conditions where it is required to increase induction value of a coil.

The induction coil assembly and the wireless power transfer system according to preferred embodiments of the present disclosure have been described in detail above, the benefits and circuit with regard to the present disclosure should not be construed as limited to the foregoing, the present disclosure will be better understood by means of the disclosed embodiments and accompanying drawings. Therefore, the foregoing disclosure and the accompanying drawings are intended to provide a better understanding of the invention, and the protection of the present invention is not limited to the scope of the present disclosure. Modifications and variations of the embodiments of the present disclosure made by those skilled in the art all fall into the scope of the present disclosure.

We claim:

1. An induction coil assembly, comprising:

at least one substrate, each including at least one through hole;

a first part of a wire of the induction coil assembly wound on a first surface of the substrate; and a second part of the wire extended onto a second surface of the substrate via one of the through holes of the substrate and wound on the second surface of the substrate wherein the wire forms an N-turn coil, locations of the windings on the first surface of the substrate and locations of the windings on the second surface of the substrate are mutually staggered with each other up and down.

2. The induction coil assembly according to claim 1, wherein the first part of the wire forms A windings, and the second part of the wire forms B windings, wherein when N is an even number, A is equal to N/2 and B is equal to N/2;

when N is an odd number, A is equal to (N+1)/2, B is equal to (N−1)/2; or, A is equal to (N−1)/2, B is equal to (N+1)/2.

3. The induction coil assembly according to claim 1, wherein a first winding of the coil is wound on the first surface of the substrate, the wire is extended onto the second surface of the substrate via a first through hole and wound on the second surface of the substrate to form a i th winding and a (i+1)th winding of the coil; and the wire is extended onto the first surface of the substrate via a second through hole and wound on the first surface of the substrate to form a (i+2)th winding and a (i+3)th winding of the coil;

and wherein i is equal to 2*j,j is an odd number greater than or equal to 1.

4. The induction coil assembly according to claim 1, wherein the wire of the induction coil assembly comprises M strands of sub wires placed together, wherein M a positive integer.

5. A wireless power transfer system, comprising:

a power transmitting terminal receiving an externally inputted electrical power supply so as to generate a spatial magnetic field; and a power receiving terminal including a receiving coil and a voltage conversion circuit, wherein the receiving coil is coupled to the spatial magnetic field so as to obtain a high frequency voltage, and the voltage conversion circuit receives the high frequency voltage so as to generate an output voltage and supply the output voltage to a load, and wherein a structure of the receiving coil adopts the induction coil assembly according to claim 1.

6. The wireless power transfer system according to claim 5, wherein the electrical power transmitting terminal includes:

an inverter circuit receiving the externally inputted electrical power supply so as to generate a primary side alternating voltage;

a transmitting coil receiving the primary side alternating voltage so as to generate the spatial magnetic field, and wherein a structure of the transmitting coil adopts the induction coil assembly.

7. An induction coil assembly, comprising:

a substrate, including at least one through hole and N layers; and a wire forming a N-turn coil with N windings wound on the N layers of the substrate, respectively;

wherein each of the N windings is wound on a first surface of a layer, and the wire is extended to an adjacent next layer via the through hole and wound on the first surface of the adjacent next layer to form a next winding.

8. The induction coil assembly according to claim 7, wherein a location of a winding on the first surface of one layer and a location of a winding on the first surface of an adjacent layer are overlapped by each other up and down.

9. The induction coil structure according to claim 8, wherein the wire of the induction coil assembly comprises M strands of sub wires placed together, wherein M is a positive integer.

10. The induction coil assembly according to claim 7, wherein a location of a winding on the first surface of one layer and a location of a winding on the first surface of an adjacent layer are mutually staggered with each other up and down.

11. The induction coil structure according to claim 10, wherein the wire of the induction coil assembly comprises M strands of sub wires placed together, wherein M is a positive integer.

* * * * *